United States Patent [19]

Hoelzel et al.

[11] 3,977,417

[45] Aug. 31, 1976

[54] SMOKING ARTICLE AND PROCESS FOR FILTERING TOBACCO SMOKE EMPLOYING A CROSS-LINKED ORGANIC OIL FILTER MATERIAL

[75] Inventors: Charles B. Hoelzel; Norman B. Rainer; Peter Allen Wilson, all of Richmond, Va.

[73] Assignee: Philip Morris Incorporated, New York, N.Y.

[22] Filed: Mar. 23, 1973

[21] Appl. No.: 344,419

[52] U.S. Cl. ..... 131/10.9; 131/265; 131/269

[51] Int. Cl.[2] ..... A24B 15/02

[58] Field of Search ..... 131/10–10.9, 131/261–269, 172

[56] References Cited

UNITED STATES PATENTS

| | | | |
|---|---|---|---|
| 2,800,908 | 7/1957 | Blank | 131/262 A |
| 2,904,050 | 9/1959 | Kiefer et al. | 131/267 |
| 3,400,722 | 9/1968 | Noznick et al. | 131/10.7 |
| 3,428,056 | 2/1969 | Sublett et al. | 131/267 |
| 3,608,564 | 9/1971 | Takahashi et al. | 131/269 |
| 3,662,765 | 5/1972 | Clark | 131/269 |
| 3,774,623 | 11/1973 | Merrill | 131/269 |

*Primary Examiner*—Robert W. Michell
*Assistant Examiner*—V. Millin

[57] ABSTRACT

The invention relates to a smoking article and to a process of filtering tobacco smoke comprising passing tobacco smoke through a particulate, solidified cross-linked organic oil. An inorganic or organic powder may be used in conjunction with the particulate solidified oil in order to improve bulk handling characteristics and to improve the filtering qualities of the material.

11 Claims, No Drawings

SMOKING ARTICLE AND PROCESS FOR FILTERING TOBACCO SMOKE EMPLOYING A CROSS-LINKED ORGANIC OIL FILTER MATERIAL

BACKGROUND OF THE INVENTION

1. Field of the Invention

The invention relates to a smoking article and to a process for filtering tobacco smoke which employs a particulate solidified cross-linked organic oil to filter tobacco smoke. The invention also relates to a novel filter material comprising a particulate solidified cross-linked organic oil in combination with an organic or inorganic powder which serves as a bulk flow-improving agent.

2. Prior Art

At present, one of the most widely used filter materials for tobacco smoke is a crimped tow of plasticized cellulose acetate which has acceptable efficiency for removal of total particulate matter (TPM) from cigarette smoke at low resistance to draw (RTD) and is relatively low in cost and easy to fabricate. The cellulose acetate tow is especially adaptable to high speed fabrication. However, many materials have been suggested or tried in efforts to provide efficient tobacco smoke filter materials (i.e., materials providing a higher TPM removal/RTD ratio) which would still meet the other criteria set forth above. Some of the materials which have been tried or suggested are porous or microporous resins such as polyurethanes, polyacetals, styrene or vinyl chloride polymers; however, none of these materials are completely satisfactory. Many of these materials are relatively high in cost; some do not possess the bulk flow characteristics required in the manufacture of tobacco smoke filters from these resins, and others are ineffective except in a form especially prepared for this end use.

SUMMARY OF THE INVENTION

The invention relates to a smoking article and to a process of filtering tobacco smoke comprising passing tobacco smoke through a particulate, solidified cross-linked organic oil. An inorganic or organic powder may be used in conjunction with the particulate solidified oil in order to improve bulk handling characteristics and to improve the filtering qualities of the material.

DETAILED DESCRIPTION OF THE INVENTION

The invention relates to a smoking article which is a combination of a filter comprising a particulate cross-linked solidified organic oil (also referred to as the particulate solidified oil) or filter material composed of said particulate solidified oil and an inorganic or organic powder in a filtering relationship with a smokeable tobacco product which includes cigarettes, cigars, pipes and all art known equivalents thereof. The filtering relationship between the particulate solidified oil or filter material and the smokeable tobacco product is effected by means or expedients well known in the art. Thus, particulate solidified oil or filter material may be employed in a filtering relationship with a cigarette or cigar by inserting the same in a space between plugs of cellulose acetate tow (a plug-space-plug arrangement) which is then placed against a cylinder of tobacco and a common wrapper is employed to contain both the tobacco and the particulate solidified oil or filter material. As an alternate embodiment, the particulate solidified oil or filtering material may be separate from the smokeable tobacco product, as a mass packed into a cigarette or cigar holder. In a similar fashion, either can be appropriately packed into the stem of a tobacco pipe. For the purposes of the present invention, all of these arrangements of smokeable tobacco products comprise a filtering relationship between the tobacco product and the filter material or particulate solidified oil.

The invention also relates to a process of filtering tobacco smoke by passing it through a particulate solidified cross-linked organic oil or filter material. Many of the particulate solidified oils employed in the present invention are commercially available products sold under various trade names. The particulate solidified oil has a particle size of from about 20 to about 200 mesh, and preferably from about 40 to about 80 mesh (U.S. Sieve Series; A.S.T.M. E-11-61).

The following table illustrates the relationship between the aforesaid Sieve Series and the particle diameter:

| Sieve Series | Particle Diameter |
|---|---|
| 20 mesh | 841 microns |
| 40 mesh | 420 microns |
| 80 mesh | 177 microns |
| 200 mesh | 74 microns |

Particulate solidified oils having a particle size up to about 74 microns in diameter or in the range from about 10 up to about 74 microns in diameter can also be used.

The compounds are prepared by taking organic oils which are liquid and may contain inter alia carbon-to-carbon unsaturation, hydroxyl groups, carboxyl groups or ester groups at room temperature and converting them into solidified particles by chemical cross-linking. The particles thus obtained are solids at room temperature and because of the cross-linking, are not thermoplastic. Vegetable oils (by which it is intended to include the glycerides, fatty acids or any combination thereof) that are commonly employed in manufacturing these materials are soy bean, castor, rape-seed, olive, peanut, corn, cottonseed, tung, safflower and linseed oils.

These vegetable oils may be cross-linked by a variety of cross-linking vulcanizing agents reactive at carbon-to-carbon double bonds, e.g., sulfur or sulfur monochloride, or by a variety of hydroxyl-reactive agents where hydroxyl groups are also present in the oils, such as the hydroxyl group of ricinoleic acid found in castor oil. These hydroxyl reactive agents include bifunctional isocyanates, epoxides, aldehydes, acid chlorides, silanes, phosphorus chlorides, etc. A number of particulate solidified vegetable oil resins are marketed by the American Cyanamid Company under the tradenames "Factice" and "Adaphax." Other organic oils which may be employed include those of synthetic or natural origin containing at least one unsaturated carbon-to-carbon double bond per molecule or at least two hydroxyl or carboxylic acid groups per molecule. Typical species of such organic oils include long chain olefins, dimer acids derived from the dimerization of fatty acids, and partially oxidized oils containing hydroxyl groups. In general, the organic oil molecule will contain at least about 12 carbon atoms, and preferably at least about 18 carbon atoms. The oil preferably has a viscosity less than about 400 poises at room temperature, i.e., about 20°C. The particulate solidfied oil is non-thermoplastic, resilient, has low strength and the ability to absorb large amounts of organic liquids and, as a result, may expand 3 to 20 times in volume. As initially formed, prior to comminution to particulate form, the cross-linked, solidified organic oil has a Shore A hardness from about 10 to about 100 and preferably from about 20 to about 60, and an elongation of less than about 200%. By way of comparison, particulate rubbers, which are ineffective as absorbers of TPM, have an elongation greater than about 200%. The particulate solidified oils may be prepared in a manner to include other components, fillers or oils (other than the oil being cross-lined) introduced at the time of preparation. These components may also be incorporated by absorption after cross-linking. Flavors may be incorporated in this way which will be released in some degree to the smoke.

In the preparation of the particulate solidified oils employed according to the present invention, any mixture of the aforementioned organic oils and their equivalents can be used as well as any mixture of suitable cross-linking agents and their equivalents. The particulate solidified oils may be given a microporous structure by the utilization of blowing agents, or removable liquids or solids during the cross-linking process, or by other expedients generally known in the polymer art. It is generally found that particles having an irregular periphery, characterized in having cracks, protrusions or other irregular contours, will afford improved filtration efficiency, such particle characterization also being obtained by methods known in the art.

The unmodified particles of solidified vegetable oils are effective as filtration agents for tobacco smoke, but their bulk flow properties are poor and, consequently, they cannot be employed without difficulty in the large scale, high speed manufacture of tobacco filters, if the particles are required to flow by gravity alone into the filters.

In another aspect of the invention, the particulate solidified vegetable oils are dusted with certain fine organic or inorganic powders by dry-blending in order to improve their handling properties, especially bulk-flow properties, to obtain filter materials for use in large scale, high speed tobacco filter manufacturing operations.

These organic or inorganic powders may have a particle size of from about 10 to about 100 microns, preferably from about 20 to about 50 microns, and are employed in an amount up to about 20%, preferably from about 1 to about 10% by weight based on the particulate solidified oil. Organic powders which may be used to treat the particulate cross-linked vegetable oils include microcrystalline cellulose such as "Avicel" PH-101 (tradename, American Viscose Division of FMC Corp.), polyethylene oxide such as "Polyox" (tradename, Union Carbide Co.), sugars, casein, metal stearates, "Sephadex" dextran gel (tradename, Pharmacia Fine Chemicals, Uppsala, Sweden), starch, carboxymethyl cellulose, other hydrogel resins, organic acids and flour. Powders having hydrophilic characteristics are generally found preferable because, in addition to improving bulk flow, they enhance the filtration efficiency of the composition.

Inorganic materials which may be employed to improve bulk handling and filtering qualities include bone char, activated carbon, such as "PCB" (tradename, Pittsburgh Activated Carbon Co.), alumina, carbon black, hydroxylapatite, fumed silica such as "Aerosil" (tradename, Degussa, Inc.), sodium carbonate or bicarbonate, hydroxides, oxides, carbonates, sulfates, phosphates, and silicates of aluminum, magnesium, or calcium, talc, kaolin, $T_iO_2$, ZnO, perlite and boric acid.

The bulk flow properties of the filter material and the particulate solidified oil of this invention are measured by means of a stainless steel funnel having a 0.95 cm diameter opening at the bottom to meet ASTM Specification D 1895-67T Method A. A sample weighing 140 g is placed in the funnel. The time in seconds is recorded for the sample to flow out of the funnel. By this test method, the preferred filter materials of this invention have flow times less than about 40 sec/140 g. In some cases where the powder material is not added to the particulate solidified oil, no flow at all is obtained, i.e., the flow time is infinite. This occurs primarily because of bridging within the sample, which halts flow.

Any mixture of the aforementioned organic powders or inorganic powders or combinations of organic and inorganic powders and their equivalents may also be employed in the filter materials.

In blending the organic or inorganic powder with the particulate solidified oil, it has been found preferable to add up to about 20 weight percent, preferably about 1 to about 10 weight percent of said powder based on such blend after which the blend is resieved to remove excess powder. The retained powder appears to be adsorbed onto the particulate solidified oil, forming an association which is not readily separated by mechanical effects or gravity. The actual weight ratio of particulate solidified cross-linked oil to powder is, therefore, a function of powder particle size, adherence to the particulate solidified oil and powder density. The powders do not appear to affect the swelling of the particulate solidified oil that takes place during the pick-up of TPM. The powder may be chosen so as to impart specific desired features to the filter, such as release of flavor or the selective removal of gas phase components, for example, by the use of activated carbon.

The present invention provides a tobacco article, as well as a method and filter materials which meet all the criteria for a good tobacco smoke filter with an exceptionally good efficiency-to-RTD ratio and is inexpensive. In the last respect, the method and filter materials have a significant advantage over the microporous resins of the prior art. These resins must be specially prepared from hard polymer for filter use and, consequently, are high in cost. A special property of particulate solidified oils is their ability to swell in volume upon absorbing TPM, which is especially useful in the type of filter disclosed in U.S. application Ser. No. 252,596, Claflin et al., now abandoned, which is assigned to the same assignee as is the present invention. The Claflin et al. application inter alia relates to a smoking article provided with a filter component of the ventilated type having a smoke flow course of a certain initial effective area extending therethrough. The filter component is constructed so that at least a portion of the ventilation air drawn in during smoking bypasses the filter component. The filter component is made of a material which is swellable responsive to exposure thereof to tobacco smoke so that during the course of smoking the filter component smoke flow course becomes constricted, increasing the resistance to draw through such component with attendant increase in dilution air intake, resulting in delivery of total particulate matter at a desired controlled level especially during the final puff stages of smoking. The present article, method and filter materials are outstandingly useful in this application.

It has also been observed that when the powder employed is hydrophilic, improvements are generally realized in the tobacco smoke filtering properties of the filter material as increases in TPM removal for a given volume of material, with substantially no increase in RTD.

The following examples are illustrative:

EXAMPLE 1

Cigarette filters were constructed of the plug-space-plug type, having a space of approximately 10 mm, and end plugs each 5 mm. of 8 denier/40,000 total denier plasticized cellulose acetate tow. This 10 mm. space was filled with "Factice" 57S-DG (tradename), American Cyanamid Co., made by cross-linking soy bean oil with sulfur monochloride) sieved to -20 mesh and treated with up to 20% by weight based on said particulate solidified oil of powders in separate experiments. Resieving on 40/80 mesh screens removed the excess powder. By adjusting the packing of the granules in the space, these filters (four for each experiment) were made to have an initial RTD of 1.5 to 3.0 inches of water. Loadings of the powder/"Factice" (tradename) were 75 to 125 mg. The filters were attached to conventional 65 mm. cigarette rods, the overall cigarette RTD being about 5 inches of water.

The cigarettes were smoked by the standard FDA procedure for TPM determination, and from known deliveries for the unfiltered rods the filter efficiency was calculated (% TPM removal). The TPM index was also calculated (efficiency divided by mg. of filter mixture employed). The results are listed in Table 1. While efficiency was improved by the addition of the powder in all instances, the TPM index was not always raised, and in a few experiments was slightly diminished. It is probable that the effect of the powder in these instances is to improve the packing of the granules to make a more dense but more efficient filter bed.

TABLE 1

SMOKE FILTRATION WITH "FACTICE" (tradename) 57S-DG — Powder Blends

| SAMPLE | POWDER* | TPM REMOVAL | TPM INDEX** |
|---|---|---|---|
| 1 | None | 48% | 0.69 |
| 2 | Hydroxylapatite | 60% | 0.86 |
| 3 | Mueller alumina | 59% | 0.84 |
| 4 | "Avicel" (tradename) microcrystalline cellulose | 70% | 1.00 |
| 5 | "Avicel" (tradename) | 72% | 0.72 |
| 6 | "Dispal" (tradename) colloidal alumina | 61% | 0.89 |
| 7 | "Polyox" (trademane) polyethylene oxide | 66% | 0.94 |
| 8 | "Aerosil" (tradename) R-972 fumed silica | 57% | 0.81 |
| 9 | "AVicel" (tradename) + "Polyox" (tradename) | 57% | 0.67 |
| 10 | PCB Carbon (tradename) −325 mesh | 68% | 0.68 |
| 11 | "Synthad" (tradename) −200 mesh bone char | 74% | 0.62 |
| 12 | Bone char −200 mesh | 71% | 0.60 |
| 13 | "Royal Spectra" (tradename) carbon black | 73% | 0.73 |
| 14 | ASP 100 (tradename) hydrous alum. silicate | 53% | 0.82 |
| 15 | ASP 105 (tradename) hydrous alum. silicate | 59% | 0.91 |
| 16 | $CaCO_3$ | 68% | 0.85 |

**% TPM removal/mg. of filter material used.

*Identification of sources of powders:

3 Adolph Mueller Co.

4 American Viscose Division of FMC Corp.

6 Continental Oil Co.

7 Union Carbide Corp.

8 Degussa, Inc.

9 Prepared by treating Sample 5 with an excess of "Polyox" and sieving.

10 Pittsburgh Activated Carbon Co.

11 Kerr-McGee Chemical Corp.

12 Kerr-McGee Chemical Corp.

13 Columbian Carbon Co.

14 Engelhard Minerals & Chemicals Corp.

15 Same; ASP 105 has been treated/cationic surfactant.

EXAMPLE 2

The procedures of the preceding Example were followed in the preparation of filters from "Adaphax-758" (tradename) granules made by the cross-linking of castor oil with toluene diisocyanate. Cigarettes were made up and tested in the same way. Results are shown in Table II. The drop in TPM index is especially noticeable here in comparison with the unpowdered sample. Sources of the inorganic or organic powders are given in Example 1.

TABLE II

| SMOKE FILTRATION WITH "ADAPHAX 758" (tradename) — POWDER BLENDS | | | |
|---|---|---|---|
| SAMPLE | POWDER | TPM REMOVAL | TPM INDEX* |
| 17 | None | 51% | 0.73 |
| 18 | "Avicel" (tradename) | 68% | 0.68 |
| 19 | "Avicel" (tradename) | 64% | 0.64 |
| 20 | PCB Carbon (tradename) −325 mesh | 60% | 0.50 |
| 21 | "Royal Spectra" (tradename) | 61% | 0.51 |
| 22 | Bone Char −200 mesh | 64% | 0.53 |
| 23 | "Synthad" (tradename) −200 mesh | 66% | 0.55 |
| 24 | $CaCO_3$ | 67% | 0.56 |

*% TPM removal/mg. of filter material used.

EXAMPLE 3

The procedures of Example 1 were followed in the preparation of filters from "Factice" (tradename) R-97 White (tradename) granules made from rape-seed oil cross-linked with sulfur monochloride. Cigarettes were assembled and test smoked as described. The results are tabulated in Table III. Again, the drop in TPM index occurred with many of the inorganic or organic powders. Sources of these powders are given in Example 1.

TABLE III

| SMOKE FILTRATION WITH "FACTICE" (tradename) R-97 White — POWDER BLENDS | | | |
|---|---|---|---|
| SAMPLE | POWDER | TPM REMOVAL | TPM INDEX* |
| 25 | None | 51% | 0.73 |
| 26 | "Avicel" (tradename) | 70% | 0.58 |
| 27 | PCB Carbon (tradename) −325 mesh | 59% | 0.49 |
| 28 | "Royal Spectra" (tradename) | 63% | 0.53 |
| 29 | Bone Char −200 mesh | 67% | 0.56 |
| 30 | "Synthad" (tradename) −200 mesh | 62% | 0.52 |
| 31 | $CaCO_3$ | 66% | 0.83 |

*% TPM removal/mg. of filter material used.

EXAMPLE 4

Five grams of "Vorite" (tradename) 128 isocyanate prepolymer based on castor oil containing 10.8% NCO groups (a product of the Baker Castor Oil Company) were mixed with 5 grams of "Polycin" (tradename) 620 ricinoleate polyol based on castor oil (a product of Baker Castor Oil Company). Two drops of dibutyl tin dilaurate were added. The mixture was de-aerated under vacuum then cured at 100°C for 4 hours. A clear yellow rubbery product was obtained having a Shore A Durometer hardness of 55 and an elongation to break of 27%. The material was found to undergo swelling of over 30% in solvents such as methyl ethyl ketone, ethyl acetate, methyl isobutyl ketone, chloroform, dimethylformamide, dimethylacetamide, and hexane.

The rubbery product was shredded and then blended with 10% by weight "Avicel" (tradename) cellulose based on the weight of the rubbery product. The mixture was sieved to 40/80 mesh size. The flow rate measurement on the sieved mixture was 29 sec/140 g. By way of comparison, the unblended, shredded product would not flow at all through the flow rate test funnel.

The sieved mixture tested for filtration efficiency by the method employed in Example 1, was found to remove 65% of TPM. The RTD of the filter was found to increase from 2.5" prior to smoking to 6.5" after smoking.

Various ranges have been set forth for the percentage of components such as the bulk flow improving organic or inorganic powders employed according to the invention, by which it is intended to include not only quantities falling within the outer limits of this range, but also a narrower range within the range and any single value within the range. Thus, where the amount of organic or inorganic powder is described as up to about 20% by weight of the particulate solidified oil, a range of from about 1 to about 10% is intended to be included within this definition, as well as a narrower range within this range, such as from about 1 to about 5 weight percent, as well as any specific value falling within that range such as, for example, 1%, 2% of the powder and the like. The various ranges given for particle size limitations of the particulate solidified oil are also intended to include the outer limits of the range, a narrower range within the range, as well as any specific value falling within the range.

Although the invention has been described by reference to some preferred embodiments, it is not intended that the novel method or filter material or the article of manufacture comprising a smokeable tobacco product in a filtering relationship with the particulate solidified oil or filter material is to be limited thereby, but that certain obvious equivalents are intended to be included within the spirit and scope of the following claims:

What is claimed is:

1. A smoking article comprising a smokeable tobacco product and in a filtering relationship therewith, a solidfied organic oil in the form of resilient, non-thermoplastic particles having a particle size of from about 20 to about 200 mesh U.S. Sieve Series where said solidified organic oil has a Shore A hardness of from about 10 to about 100, an elongation of less than about 200% and which have the capacity to absorb sufficient amounts of organic liquids to expand from 3 to 20 times in volume.

2. The article of claim 1 comprising a smokeable tobacco product and in a filtering relationship therewith, a particulate solidified organic oil having a particle size of from about 20 to about 200 mesh U.S. Sieve Series, said oil being selected from at least one member of the class of oils consisting of soy bean, castor, rapeseed, olive, peanut, corn, cottonseed, tung, safflower and linseed oils, said oil being solidified by chemical cross-linking where said solidified organic oil has a Shore A hardness of from about 10 to about 100 and an elongation of less than about 200%.

3. The article of claim 1 where said oil has at least about 12 carbon atoms in the molecule and a viscosity of less than about 400 poises at room temperature and is selected from at least one member of the group consisting of olefins, fatty acid dimers and oxidized oil containing hydroxyl groups, where said solidified organic oil has a Shore A hardness of from about 10 to about 100 and an elongation of less than about 200%.

4. A smoking article comprising a smokeable tobacco product and in a filtering relationship therewith, a particulate solidified cross-linked organic oil having a particle size of from about 20 to about 200 mesh U.S. Sieve Series and up to about 20 weight percent based on said oil of powder selected from at least one member of the group consisting of inorganic powders and organic powders, said powder being hydrophilic and having a particle size of from about 1 to about 100 microns where said solidified organic oil has a Shore A hardness of from about 10 to about 100 and an elongation of less than about 200% and which have the capacity to absorb sufficient amounts of organic liquids to expand from 3 to 20 times in volume.

5. The article of claim 4 where said particulate oil is selected from a member of the class of oils consisting of soy bean, castor, rape-seed, olive, peanut, corn, cottonseed, tung, safflower and linseed oils, said oil being solidified by chemical cross-linking where said solidified organic oil has a Shore A hardness of from about 10 to about 100 and an elongation of less than about 200%.

6. The article of claim 4 where said oil has at least about 12 carbon atoms in the molecule and a viscosity of less than about 400 poises at room temperature and is selected from at least one member of the group consisting of alpha-unsaturated olefins, fatty acid dimers and oxidized oil containing hydroxyl groups, where said solidified organic oil has a Shore A hardness of from about 10 to about 100 and an elongation of less than about 200%.

7. A process of filtering tobacco smoke comprising passing said smoke through a particulate solidified organic oil having a particle size of from about 20 to about 200 mesh U.S. Sieve Series where said solidified organic oil has a Shore A hardness of from about 10 to about 100 and an elongation of less than about 200% and wherein said oil is vegetable oil selected from at least one member of the class of oils consisting of soy bean, castor, rape seed, olive, peanut, corn, cottonseed, tung, safflower and linseed oils and said oil is solidified by chemical cross-linking.

8. The process of claim 7 where said oil has at least about 12 carbon atoms in the molecule and a viscosity of less than about 400 poises at room temperature and is selected from at least one member of the group consisting of alpha-unsaturated olefins, fatty acid dimers and oxidized oil containing hydroxyl groups, where said solidified organic oil has a Shore A hardness of from about 10 to about 100 and an elongation of less than about 200%.

9. A filter material for tobacco smoke comprising a particulate solidified organic oil having a particle size of from about 20 to about 200 mesh U.S. Sieve Series and up to about 20 weight percent based on said vegetable oil of a powder selected from at least one member of the group consisting of an inorganic powder and an organic powder, said powder being hydrophilic and having a particle size of from about 1 to about 100 microns where said solidified organic oil has a Shore A hardness of from about 10 to about 100 and an elongation of less than about 200% and which have the capacity to absorb sufficient amounts of organic liquids to expand from 3 to 20 times in volume.

10. The filter material of claim 9 where said oil is selected from at least one member of the class of oils consisting of soy bean, castor, rape-seed, olive, peanut, corn, cottonseed, tung, safflower and linseed oils, said oil being solidified by chemical cross-linking where said solidified organic oil has a Shore A hardness of from about 10 to about 100 and an elongation of less than about 200%.

11. The filter material of claim 9 where said oil has at least about 12 carbon atoms in the molecule and a viscosity of less than about 400 poises at room temperature and is selected from at least one member of the group consisting of alpha-unsaturated olefins, fatty acid dimers and oxidized oil containing hydroxyl groups, where said solidified organic oil has a Shore A hardness of from about 10 to about 100 and an elongation of less than about 200%.

* * * * *